US006234230B1

(12) United States Patent
Petitjean

(10) Patent No.: US 6,234,230 B1
(45) Date of Patent: May 22, 2001

(54) DEVICE FOR CONTINUOUSLY APPLYING SELF-ADHESIVE HANDLES TO MOVING ARTICLES

(75) Inventor: Cyriaque Petitjean, Charanthonay (FR)

(73) Assignee: Cefma Company, Genas (FR)

( * ) Notice: Subject to any disclaimer, the term of this patent is extended or adjusted under 35 U.S.C. 154(b) by 0 days.

(21) Appl. No.: 09/293,930

(22) Filed: Apr. 19, 1999

(30) Foreign Application Priority Data

Dec. 16, 1998 (FR) ..... 98 16074

(51) Int. Cl.[7] ..... B26D 5/00; B26D 7/00

(52) U.S. Cl. ..... 156/522; 156/302; 156/355; 156/358; 156/565; 156/570; 156/571; 156/572

(58) Field of Search ..... 156/522, 355, 156/358, 270, 302, 565, 570, 571, 572

(56) References Cited

U.S. PATENT DOCUMENTS 5,458,726 * 10/1995 Castoldi ..... 156/355

FOREIGN PATENT DOCUMENTS 0 560 699 B1 9/1993 (EP) .
870148 6/1961 (GB) .
94/12395 6/1994 (WO) .

* cited by examiner

*Primary Examiner*—Linda L. Gray
(74) *Attorney, Agent, or Firm*—Oliff & Berridge, PLC

(57) ABSTRACT

A device that continuously applies self-adhesive handles to moving articles using a pivotable paddle that can rotate approximately 180 degrees from a vertical stopped position. The rotation of the paddle is synchronized with the movement of the articles so that an adhesive tape can be applied to a moving article by placing a first end of the tape on a downstream face of the article, and a second end of the tape is applied to an upstream face of the article, thereby forming a handle on the article. Clamps are used to temporarily connect the paddle to the tape as well as pull the tape while a knife is used for cutting the tape.

17 Claims, 6 Drawing Sheets

DEVICE FOR CONTINUOUSLY APPLYING SELF-ADHESIVE HANDLES TO MOVING ARTICLES

BACKGROUND OF THE INVENTION

The invention relates to a device for the continuous application of self-adhesive handles to moving articles.

Conventional devices are mounted on a frame and include: means for supporting a spool of adhesive tape on one face, means for guiding the tape to a handle application station, a station that applies a section of non-adhesive tape or a label to the adhesive surface of the tape to form the gripping area of each handle with regular spacing, and at the application station, a paddle rotating about a horizontal, transverse axis that is disposed above the trajectory of the articles moving on a conveyor belt. The paddle is connected to drive means that can cause it to pivot one half-turn synchronously with movement of an article from a vertical position in which its lower part is in the trajectory of the articles and its face that supports the tape faces upstream, and being provided with holding means that temporarily and/or sequentially connect each of its lengthwise faces with the handle formed at the end of adhesive tape to pull this tape and apply its non-adhesive back to said lengthwise face, and, additionally, cooperates with means for cutting the end handle off the tape.

With such a conventional device, when an article comes in contact with the lower end of the vertically disposed paddle and presenting the non-cut handle of the adhesive tape and disposed with its adhesive face facing the moving article, a detector causes the paddle to rotate one half-turn. After the adhesive end of the handle has been applied to the downstream face of the article, upstream tilting of the paddle, during which tilting said paddle assumes a horizontal position above the article before returning to the vertical position just behind the article, guides the wrapping of the handle while bringing and applying the other adhesive end of this handle against the upstream face of the article.

Simultaneously, rotation of the paddle unwinds the adhesive tape and brings the next handle against the other lengthwise face of the paddle, namely against the face which, at the end of the cycle, points upstream.

As soon as the paddle has become vertical once again, the upstream end of the handle applied to the article is cut from the adhesive tape to enable the object to continue its movement.

Such a device is described in European Patent 560,699 in the name of the applicant according to which each end of the paddle has means for holding the adhesive tape, but also cutting means. The holding means are comprised of levers oscillating in the traverse plane and coming together to grip the tape in order to pull the tape and to form a counter-blade cooperating with the cutter blade that cuts the tape.

In the absence of regular maintenance and replacement of the two knives as soon as they become dull, this arrangement causes operating mishaps requiring production downtime. Typical mishaps are insufficient cutting, excessive adhesion of the tape to the clamp, fouling of the cutting means, and tearing off of the applied handle.

Another drawback of this device is that it requires precise adjustments of the timing means for the movements of the clamps and the movements of the knives.

Finally, the arrangement, at each end of the paddle, of the holding and cutting mechanisms with their drive means causes weights and inertias that limit the rotational speed of the paddle and, in any event, do not allow it to function satisfactorily at the high speeds now required, which are on the order of 80 to 100 articles/minute.

SUMMARY OF THE INVENTION

This invention provides a device that simplifies and lightens the structure of the paddle and eliminates cutting mishaps while allowing the device to function at higher speeds.

The device, according to the invention, provides cutting means that include, on each of the two ends of the paddle, a transverse cylinder reversing the adhesive tape, the cylinder being spaced from the end of the paddle to which it is connected by a lateral support, and by a transverse cutting blade supported by the frame and disposed such that it becomes inserted between the cylinder and the end of the paddle that is upstream of the trajectory of the objects, when said paddle is substantially horizontal, while the holding means are comprised of two clamps supported by the paddle and disposed lengthwise on either side of and near the rotational axis of the paddle, each clamp cooperating with means disposed outside the paddle and controlling its movements between a holding position, in which it holds part of the adhesive tape provided with the label on the corresponding lengthwise face of the paddle, and a retracted position in which the clamp is transversely remote from the aforesaid face to enable the adhesive tape to be placed on the article.

Thus, separation of the handle from the rest of the tape takes place outside of the transfer area and before the transfer to the moving object, by means of a knife assuming a fixed position at this time and the cylinder provided at the end of the paddle forming a counter-blade. When the cut takes place, the cut-off end of the tape remains applied to the face of the paddle by the movement thereof until the adhesive part comes in contact with the downstream face of the next moving article. Before cutting, the section of adhesive tape to be applied to the article is connected to the paddle by actuation of a clamp.

This device, which uses the energy of the paddle to bring about cutting relative to a fixed knife, and holds the adhesive tape in its area covered by the label, eliminates all cutting problems and problems resulting from the sticking of the adhesive to the clamps, thus ensuring proper functioning of the application operation.

The arrangement of clamps on either side of a rotating shaft of the paddle reduces inertia and enables the paddle to be subjected to greater accelerations and declarations without needing to be oversized to withstand the kinetic energy.

These and other objects of the invention will be described in or be apparent from the following description of the preferred embodiment.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1:
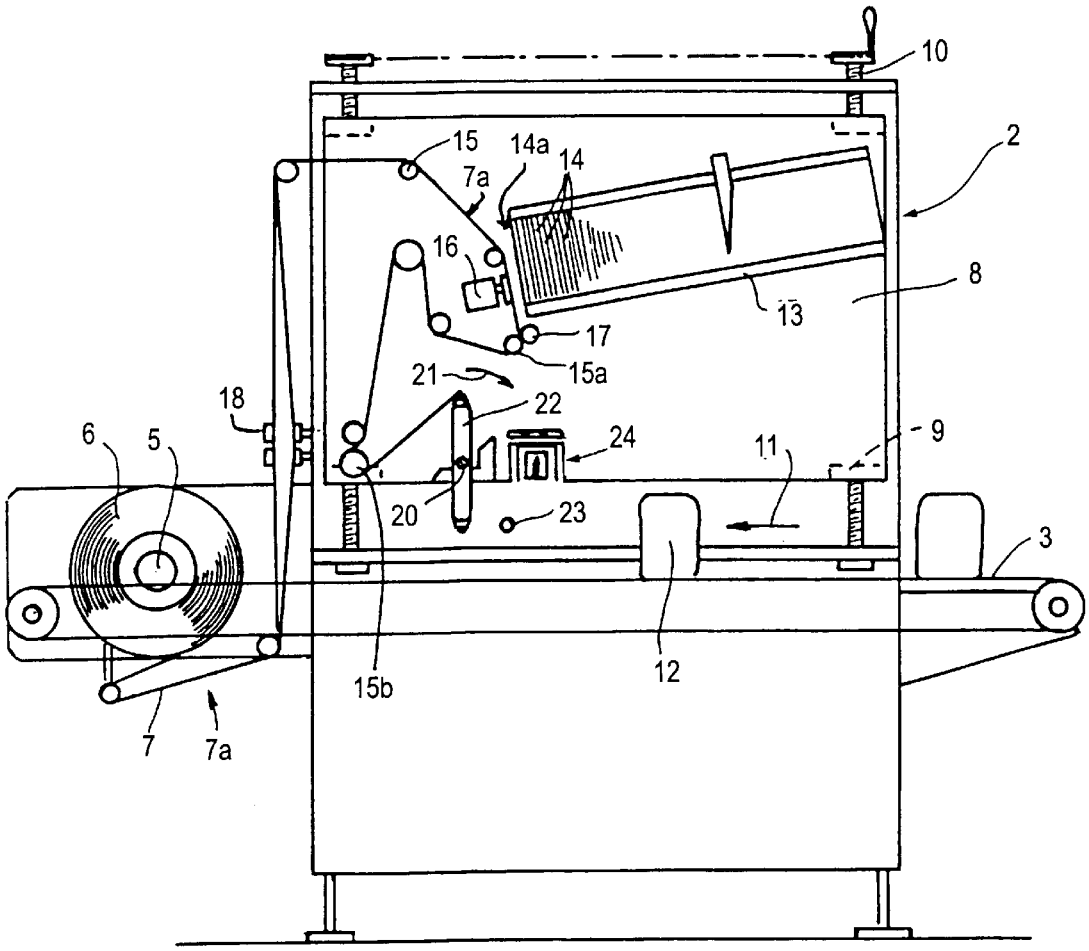
FIG. 1 is a perspective side view of a machine equipped with a self-adhesive handle applying device according to the invention.

As shown in FIG. 1, the self-adhesive device, according to the invention, may be incorporated into a machine having a frame 2 with a horizontal conveyor belt 3 and a supply roll 5 with a spool 6 of adhesive tape 7. The frame 2 also has a vertical plate 8 disposed laterally on one side of the conveyor belt 3 to provide support for the frame 2. A rear face of the vertical plate 8 supports two vertically spaced pairs of nuts 9. A vertical threaded rod 10 enables the vertical position of the vertical plate 8 relative to the conveyor belt 3 to be adjusted. As the vertical plate 8 is screwed to the pairs of nuts 9, the vertical position of the device can be adjusted relative to the height of articles, particularly packages 12, transported along the conveyor belt 3.

The vertical plate 8 supports a magazine 13 containing a stack of sections of non-adhesive tape or labels 14. Deflecting rollers 15 guide the adhesive tape 7 to an outlet orifice 14*a* of the magazine 13, where the adhesive tape 7 follows a trajectory parallel to a first non-adhesive label 14. A pneumatically or electrically actuated pusher 16 temporarily applies the adhesive tape 7 against the first non-adhesive label 14, before the tape 7 and label 14 pass through a nip created by a pressure roller 17 cooperating with a deflecting roller 15*a*. These various means relative to dispensing of the adhesive tape 7 are associated with rollers 18 that are supported by the frame 2 and ensure the reversal of the adhesive tape 7 so the adhesive face 7*a* of the tape 7 faces the first label 14 when the tape 7 passes in front of the first label 14.

With the aid of the pusher 16, the tape 7 can pick up a label 14 while moving. The label 14 is fixed to the tape 7 by passing the tape 7 and label 14 between the nip formed by the pressure roller 17 and deflecting roller 15*a*. The labels 14, which are designed to form the gripping area of the handle, are spaced lengthwise from each other by adhesive areas that will eventually be applied to the sides of the package 12. More specifically, a label 14 is located between the portions of the tape 7 applied to an upstream face 12*a* and a downstream face 12*b* of each package 12.

The vertical plate 8 also supports a bearing (not shown) of a transverse horizontal shaft 20. The horizontal shaft 20 is disposed above the path along which the packages 12 travel and supports a paddle 22. The horizontal shaft 20 is connected to drive means (not shown) that can move the paddle 22 through a half-turn relative to the vertical position shown in FIG. 1. The frame 2 has a sensor 23 upstream of the paddle 22 that detects the passage of each package 12 and controls the power to the drive means driving the paddle 22. Additionally, the vertical plate 8 also supports a knife 24 that is upstream of the paddle 22.

Figure 2:
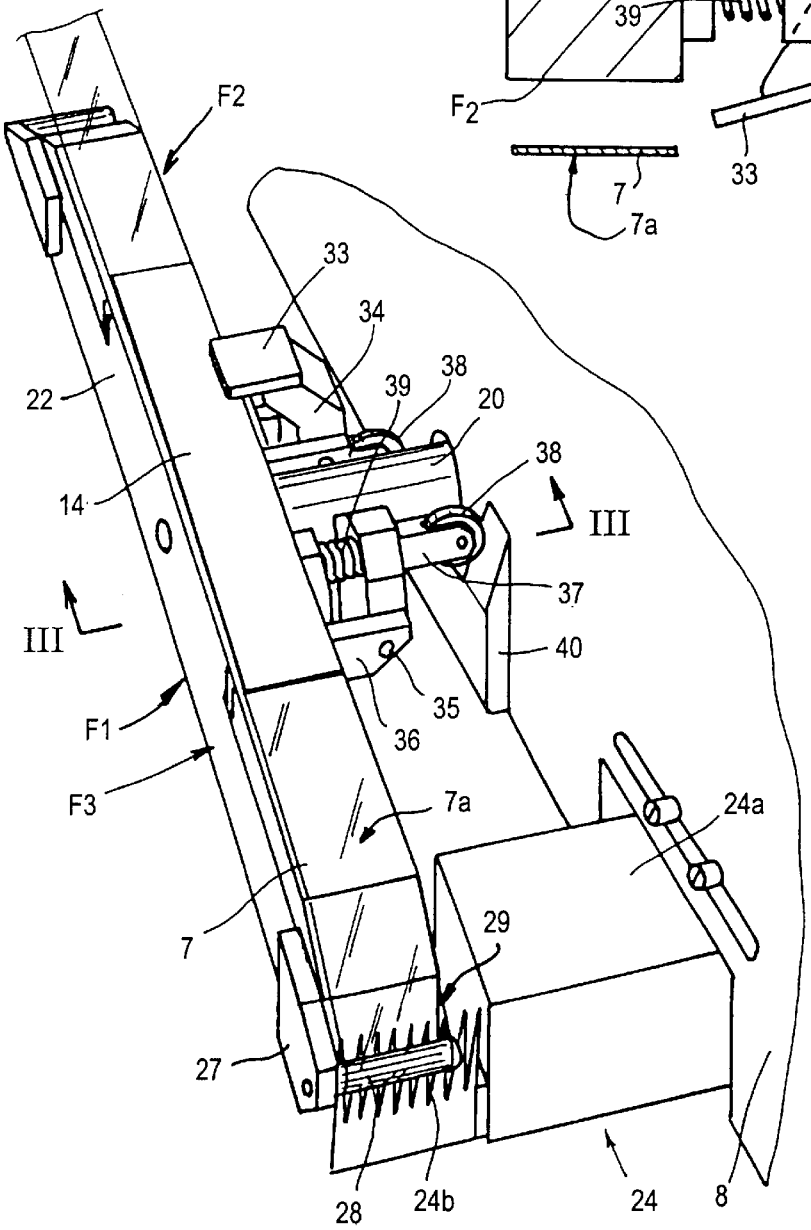
FIG. 2 is a partial perspective end view of a paddle in a handle cutting position.
Figure 4:
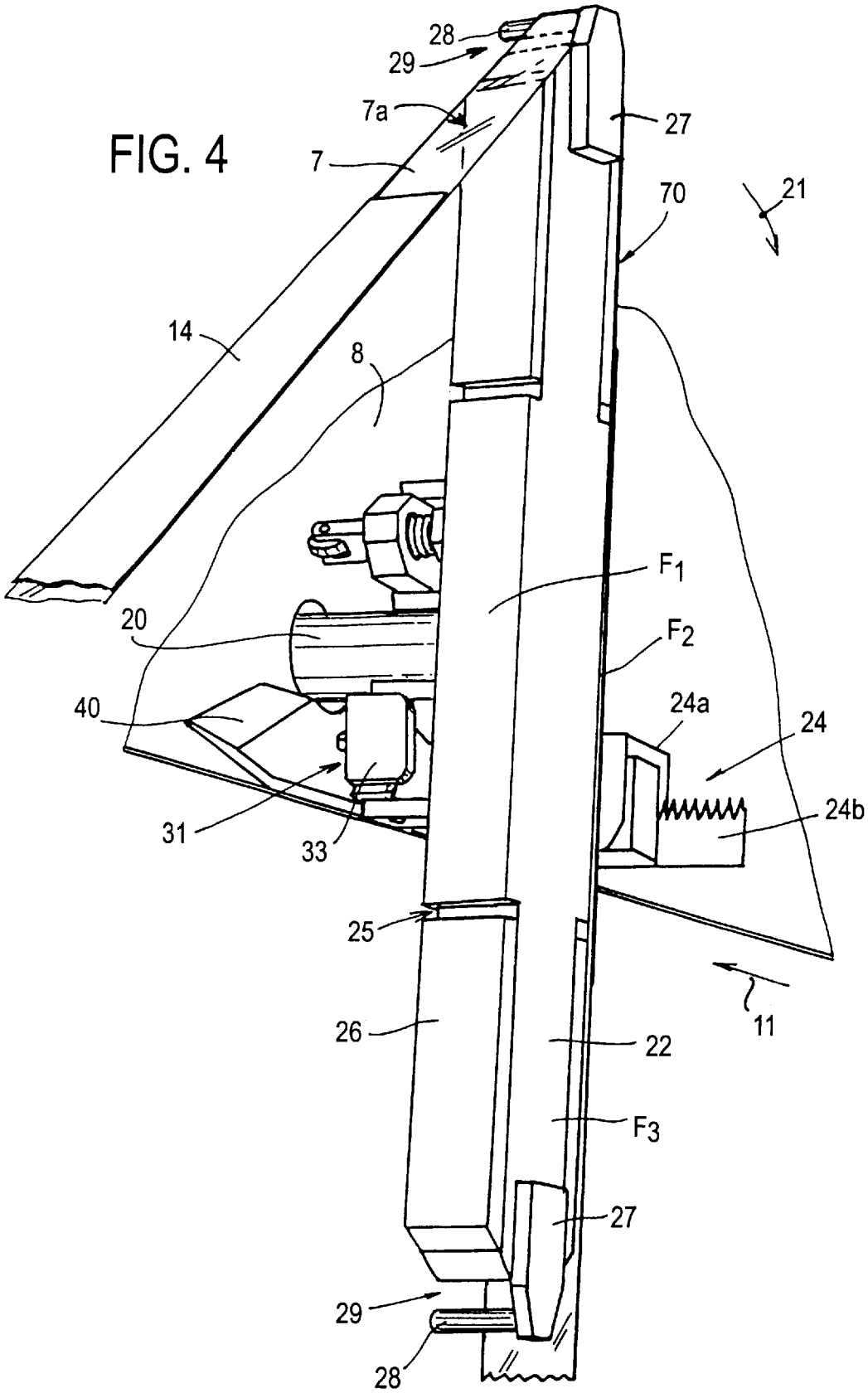
FIG. 4 is a partial perspective view of the paddle in a vertical standby position.

As shown in greater detail in FIGS. 2 and 4, the paddle 22 includes a metal bar having a rectangular cross section connected at a center of the bar with the horizontal shaft 20. The bar has two longitudinal side faces F3 and F4 in addition to a top face F1 and a bottom face F2. As shown in FIG. 4, near each end of each face F1 and F2, the paddle 22 has a recess 25 in which a pad 26, made of an elastic, compressible material, such as an elastomer, is disposed. Also, each end of the longitudinal side face F3 of the paddle 22 has a leg 27 attached thereto for transversely supporting a cylinder 28. The cylinder 28 is separated from the end of the paddle 22 by a space 29, as shown in FIGS. 4–9.

Figure 3:
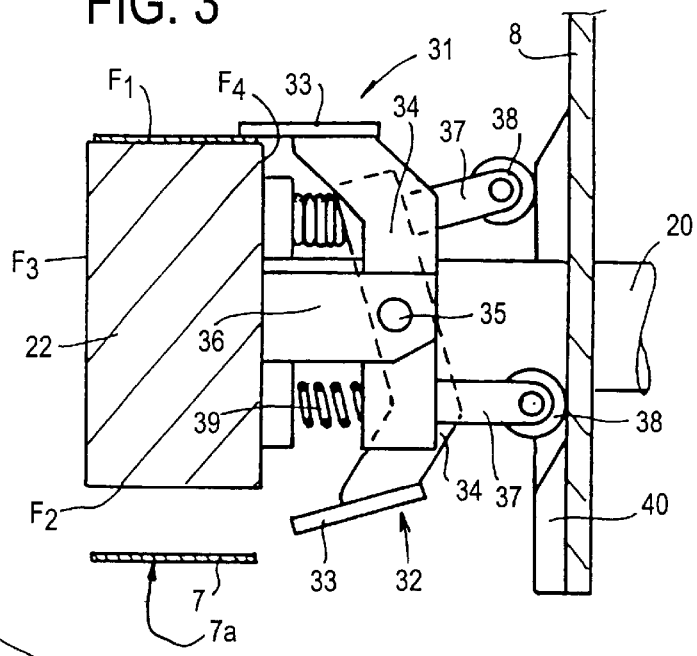
FIG. 3 is a partial cross-sectional view of holding clamps taken along line 3—3 in FIG. 2.

The paddle 22 cooperates with clamps 31 and 32 which engage the top and bottom faces F1 and F2. The clamps 31 and 32 are disposed near either side of the horizontal shaft 20. Each clamp is independent of the other and, as shown in FIG. 3, includes a plate 33 provided at one end with a lever 34 articulated substantially at a center of the clamp 31, 32 to an axis 35. The axis 35 is supported by a lug 36 projecting from the side face F4 of the paddle 22. The other end of the lever 34 is joined to a leg 37 projecting transversely opposite the paddle 22 and can contact a cam 40 using, for example, a roller 38 at the end of the lever 34. A spring 39, such as a coil spring, is interposed between the paddle 22 and the end of the lever 34 supporting the leg 37 to hold the clamp 31, 32 in the closed position. The two rollers 38 cooperate with the cam 40 mounted on a front face of the vertical plate 8.

Thus, when the paddle 22 rotates, the rollers 38 engage the cam 40 by springs 39 to control the opening and closing movements of each clamp 31 and 32, as will be explained in detail below.

As shown in FIGS. 2 and 4, the knife 24 includes a support 24*a* and a toothed blade 24*b*, each projects transversely from the front face of the vertical plate 8. The toothed blade 24*b* is positioned lengthwise relative to a geometric axis of the rotatable horizontal shaft 20 such that the toothed blade 24*b* can be inserted into the space 29, as shown in FIG. 2, between the cylinder 28 and the end of the paddle 22 supporting the toothed blade 24*b*. The toothed blade 24*b* can cut the adhesive tape 7 in an area of the tape 7 extending between the paddle 22 and the cylinder 28, namely the overlapping space 29 shown in FIG. 4.

FIGS. 1 and 2 show the toothed blade 24*b* disposed vertically so that the cutting operation occurs when the paddle 22 is substantially horizontal relative to the conveyor belt 3.

Figure 5:
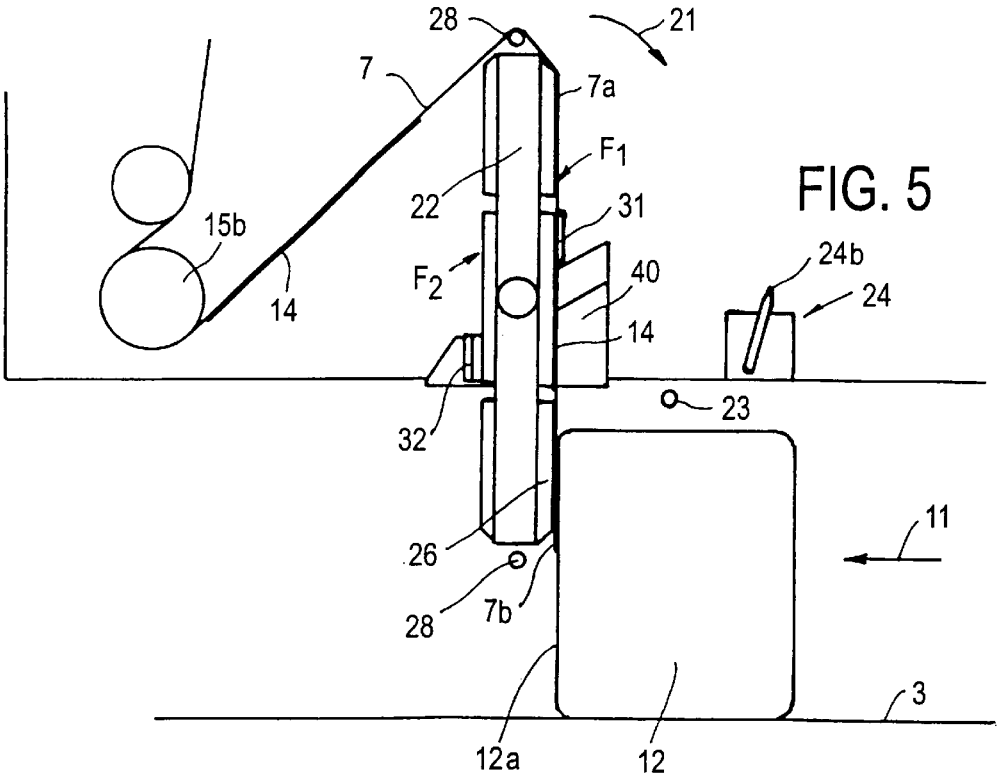
FIGS. 5–9 are side elevational views showing the different positions of the paddle when applying an adhesive handle to a moving package.

When the handle-placing device is in the resting position, the paddle 22 is vertical relative to the conveyor belt 3 and, as shown in FIG. 5, has on the face F1 facing upstream relative to the movement direction of conveyor belt 3, represented by arrow 11, a length of adhesive tape 7 corresponding to one handle. The adhesive tape 7 is disposed with the adhesive face 7*a* directed upstream, and in its middle part is covered with a label 14 forming the handle-gripping area. FIG. 5 shows a lower end 7*b* of the tape 7 is free and that, at an upper part, the tape 7 partially surrounds the cylinder 28 coming from deflecting roller 15*b*. Clamp 31 is in the closed position while clamp 32, associated with the bottom face F2, is in the open position.

Figure 6:
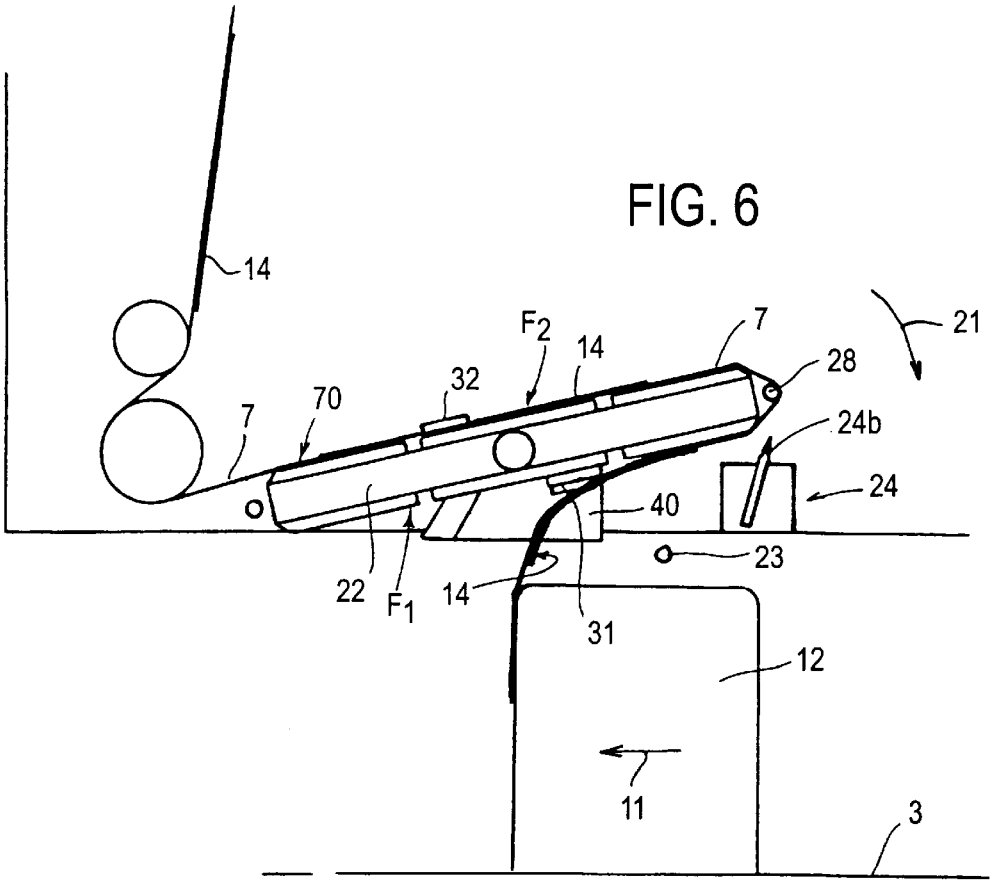

When a package 12 enters the handle-placement area, the package 12 is detected by the sensor 23, which controls the power supply to the drive means of the paddle 22 so the paddle 22 pivots one half-turn in the direction of arrow 21 synchronously with the movement of the package 12. The package 12 thus engages its downstream face 12*a* against the lower part of the paddle 22. In particular, the downstream face 12*a* engages the part of the paddle 22 equipped with a compressible pad 26 absorbing the possible differences in speed, while allowing better application of the adhesive part 7*a* of the tape 7. At the same time the package 12 travels along the conveyor belt 3, as shown in FIG. 6, the paddle 22 pivots about the horizontal shaft 20, allowing the adhesive tape 7 to be applied to the bottom face F2. As soon as it is fully in contact with the bottom face F2, the cam 40 causes the clamp 32 to close, as shown in FIG. 6. Simultaneously, the other clamp 31 begins to open after guiding the wrapping above the package 12 of the part of the adhesive tape 7 bearing the label 14.

Figure 7:
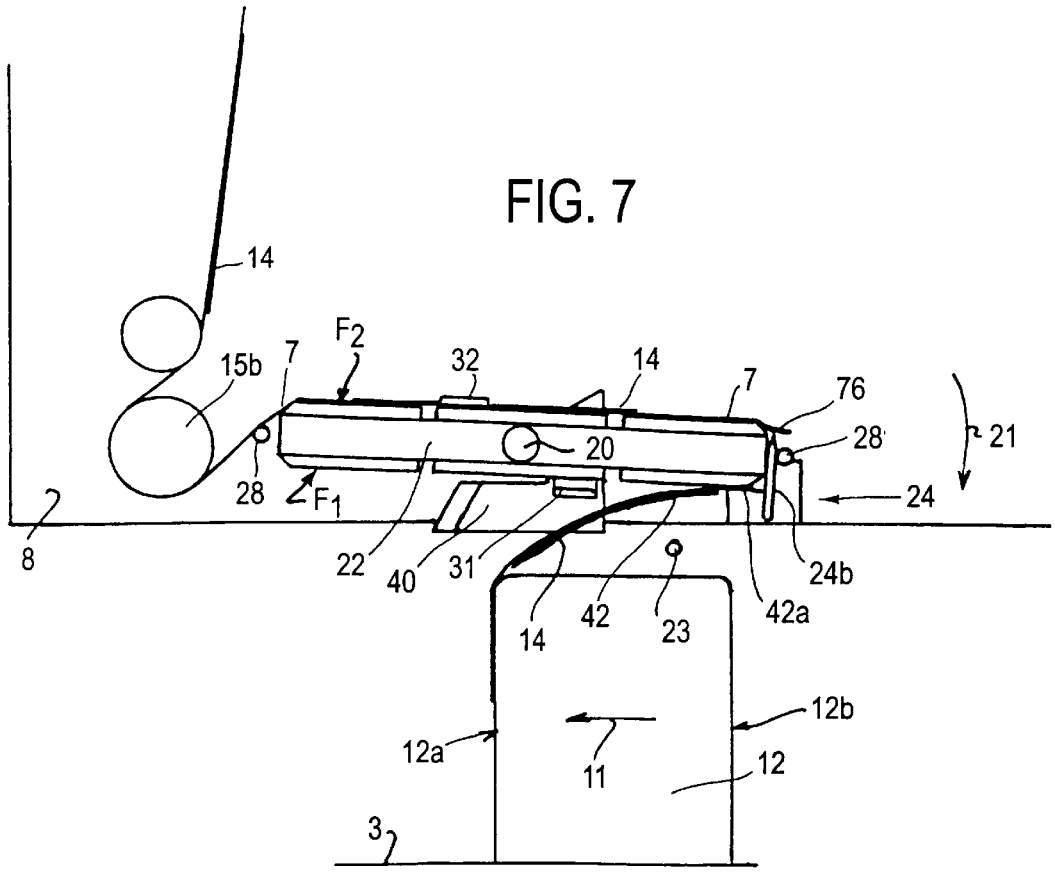
Figure 8:
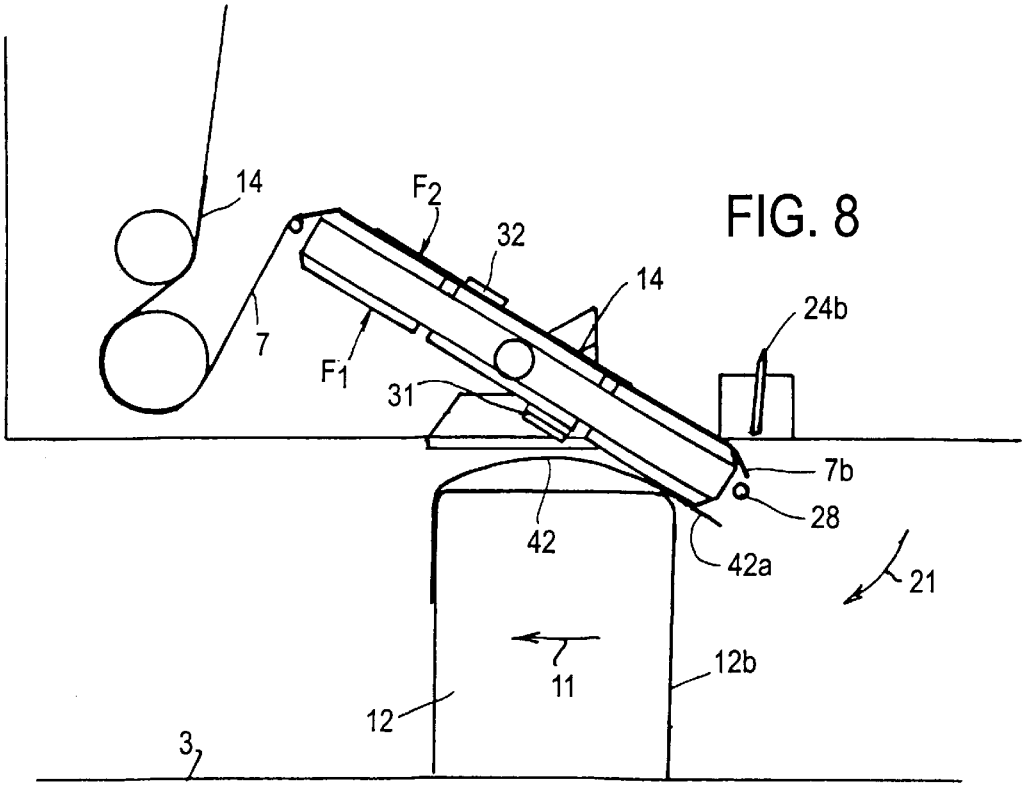

When, as shown in FIG. 7, the paddle 22 approaches the horizontal position, the toothed blade 24*b* of the knife 24 penetrates between the upstream end of the paddle 22 and the corresponding cylinder 28, namely the knife 24 is inserted into the space 29 as the knife 24 cuts a handle 42 out of the adhesive tape 7. The cutting process takes place at the same time the paddle 22 is pivoting. The cut-off part of the handle 42 remains applied against the top face F1 of the paddle 22 which can thus, at the end of its movement, and as shown in FIGS. 8 and 9, apply the adhesive upstream end 42*a* of handle 42 against the upstream face 12*b* of the package 12.

Figure 9:
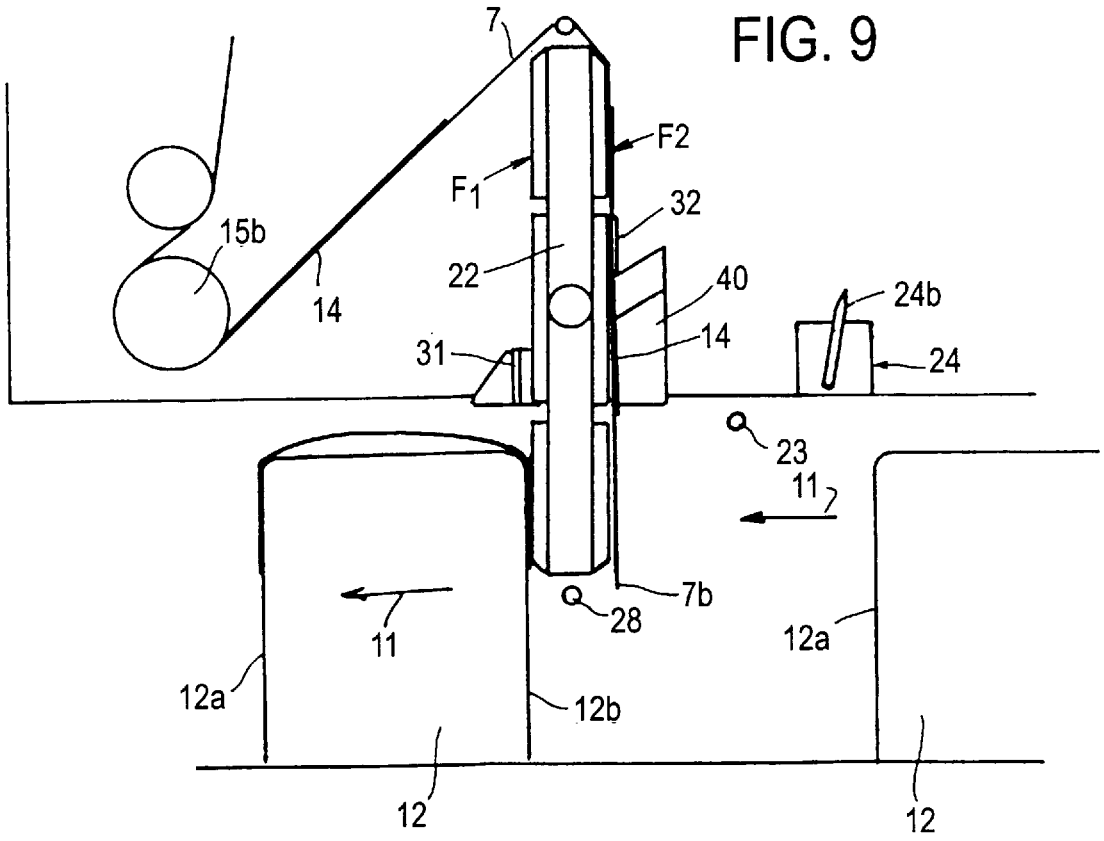

At the end of the cycle, and as shown in FIG. 9, the paddle 22 is in a starting position, ready to place the next handle 42 on the package 12 brought to it by the conveyor belt 3.

In this device, the paddle is considerably simplified relative to that of the prior art and is unencumbered with complex cutting means requiring precise adjustments. While it cooperates with clamps, the latter are disposed near to its axis of rotation and no longer cooperate with the adhesive parts of the tape but instead cooperate with the parts protected by labels, which eliminates any adhesion mishaps. Finally, the reduction in the inertia of the paddle enables it to be driven rotationally at higher speed, and even to be subjected to greater accelerations or declarations that have regular values.

While the invention has been described in conjunction with a specific embodiment thereof, it is evident that many alternatives, modifications and variations may be apparent to those skilled in the art. Accordingly, the preferred embodiment of the invention as set forth herein is intended to be illustrative, not limiting. Various changes may be made without departing from the spirit and scope of the invention.

What is claimed is:

1. A device for continuously applying self-adhesive handles to moving articles transported by a moving support comprising:

a handle applying station;

guiding means for guiding an adhesive tape from a roll to the handle applying station;

a handle forming station to apply a section of non-adhesive material to an adhesive surface of the adhesive tape resulting in formation of the handle;

a paddle positioned at the handle applying station, the paddle having two ends and being pivotable about a shaft that is horizontally disposed above the moving support transverse to a longitudinal moving direction of the moving support, the paddle receiving the handle from the handle forming station;

holding means for holding the handle against the paddle, the holding means being positioned adjacent both sides of the horizontal shaft; and cutting means for cutting the handle against the paddle away from the adhesive tape the cutting means being located at both ends of the paddle and cooperating with the holding means, wherein the holding means alternates between a holding position, at which the handle is held against the paddle so that the adhesive surface of the handle faces away from the paddle, and a retracted position, at which the holding means is transversally distant from the paddle so the adhesive surface of the handle can be placed on the moving articles;

wherein the holding means further comprises:

a first clamp on a first side of the horizontal shaft; and a second clamp on a second side of the horizontal shaft, wherein the first and second clamps each cooperate with a cam to alternate the holding means between the holding and retracted positions.

2. The device according to claim 1, wherein each clamp further comprises:

an axis parallel to a longitudinal axis of the paddle;

a lever articulated on the axis, the lever having a plate attached at a first end of the lever and extending toward the paddle and a leg attached near a second end of the lever and extending away from the paddle;

a spring located between the clamp and the paddle, the spring controlling the opening and closing movements of the clamp; and contacting means for contacting the cam when the paddle pivots about the horizontal shaft.

3. The device according to claim 2, wherein the contacting means is a roller.

4. A device for continuously applying self-adhesive handles to moving articles transported by a moving support comprising:

a handle applying station;

guiding means for guiding an adhesive tape from a roll to the handle applying station;

a handle forming station to apply a section of non-adhesive material to an adhesive surface of the adhesive tape resulting in formation of the handle;

a paddle positioned at the handle applying station, the paddle having two ends and is pivotable about a shaft that is horizontally disposed above the moving support transverse to a longitudinal moving direction of the moving support, the paddle receiving the handle from the handle forming station;

holding means for holding the handle against the paddle, the holding means being positioned adjacent both sides of the horizontal shaft; and cutting means for cutting the handle against the paddle away from the adhesive tape, the cutting means comprising:

a lateral support having a first end and a second end, the first end of the lateral support being attached to an end of the paddle such that the second end is located distant from the end of the paddle;

a cylinder extending from the second end of the lateral support parallel to the horizontal shaft resulting in a space between the cylinder and end of the paddle; and a cutting blade positioned in the space between the cylinder and end of the paddle, the cutting means cooperating with the holding means, wherein the holding means alternates between a holding position, at which the handle is held against the paddle so that the adhesive surface of the handle faces away from the paddle, and a retracted position, at which the holding means is transversally distant from the paddle so the adhesive surface of the handle can be placed on the moving articles.

5. The device according to claim 4, wherein the paddle further comprises first and second handle support faces that receive the non-adhesive surface of the handle.

6. The device according to claim 5, wherein the first and second handle support faces are orthogonal relative to the moving support when the paddle is in a resting position.

7. The device according to claim 6, wherein the paddle can pivot within a range between zero degrees and 180 degrees relative to the resting position.

8. The device according to claim 4, wherein the holding means further comprises:

a first clamp on a first side of the horizontal shaft; and a second clamp on a second side of the horizontal shaft, wherein the first and second clamps each cooperate with a cam to alternate the holding means between the holding and retracted positions.

9. The device according to claim 8, wherein each clamp further comprises:

an axis parallel to a longitudinal axis of the paddle;

a lever articulated on the axis, the lever having a plate attached at a first end of the lever and extending toward the paddle and a leg attached near a second end of the lever and extending away from the paddle;

a spring located between the clamp and the paddle, the spring controlling the opening and closing movements of the clamp; and contacting means for contacting the cam when the paddle pivots about the horizontal shaft.

10. The device according to claim 9, wherein the contacting means is a roller.

11. The device according to claim 4, wherein the cutting means is located at both ends of the paddle.

12. The device according to claim 4, wherein the section of non-adhesive material is one of either tape or a label.

13. The device according to claim 4, wherein the section of non-adhesive material is applied to the adhesive tape at predetermined intervals.

14. The device according to claim 4, wherein the application of the section of non-adhesive material to the adhesive tape forms a gripping area resulting in the handle.

15. The device according to claim 4, wherein the moving support is a conveyor belt.

16. A device for continuously applying self-adhesive handles to moving articles transported by a moving support comprising:

a handle applying station;

guiding means for guiding an adhesive tape from a roll to the handle applying station;

a handle forming station to apply a section of non-adhesive material to an adhesive surface of the adhesive tape resulting in formation of the handle;

a paddle positioned at the handle applying station, the paddle having two ends and is pivotable about a shaft that is horizontally disposed above the moving support transverse to a longitudinal moving direction of the moving support, the paddle receiving the handle from the handle forming station;

holding means for holding the handle against the paddle, the holding means being positioned adjacent both sides of the horizontal shaft; and cutting means for cutting the handle against the paddle away from the adhesive tape, the cutting means located at both ends of the paddle and comprising:

a lateral support having a first end and a second end, the first end of the lateral support being attached to an end of the paddle such that the second end is located distant from the end of the paddle;

a cylinder extending from the second end of the lateral support parallel to the horizontal shaft resulting in a space between the cylinder and end of the paddle; and a cutting blade positioned in the space between the cylinder and end of the paddle, the cutting means cooperating with the holding means, wherein the holding means alternates between a holding position, at which the handle is held against the paddle so that the adhesive surface of the handle faces away from the paddle, and a retracted position, at which the holding means is transversally distant from the paddle so the adhesive surface of the handle can be placed on the moving articles.

17. A device for continuously applying self-adhesive handles to moving articles transported by a moving support comprising:

a handle applying station;

guiding means for guiding an adhesive tape from a roll to the handle applying station;

a handle forming station to apply a section of non-adhesive material to an adhesive surface of the adhesive tape resulting in formation of the handle;

a paddle positioned at the handle applying station, the paddle having two ends and being pivotable about a shaft that is horizontally disposed above the moving support transverse to a longitudinal moving direction of the moving support, the paddle receiving the handle from the handle forming station;

holding means for holding the handle against the paddle, the holding means being positioned adjacent both sides of the horizontal shaft; and cutting means for cutting the handle against the paddle away from the adhesive tape, the cutting means being located at both ends of the paddle and cooperating with the holding means, wherein the holding means alternates between a holding position, at which the handle is held against the paddle so that the adhesive surface of the handle faces away from the paddle, and a retracted position, at which the holding means is transversally distant from the paddle so the adhesive surface of the handle can be placed on the moving articles;

wherein each cutting means further comprises:

a lateral support having a first end and a second end, the first end of the lateral support being attached to an end of the paddle such that the second end is located distant from the end of the paddle;

a cylinder extending from the second end of the lateral support parallel to the horizontal shaft resulting in a space between the cylinder and end of the paddle; and a cutting blade positioned in the space between the cylinder and end of the paddle.

* * * * *